United States Patent [19]

Johnson et al.

[11] Patent Number: 5,075,547

[45] Date of Patent: Dec. 24, 1991

[54] QUADRUPOLE ION TRAP MASS SPECTROMETER HAVING TWO PULSED AXIAL EXCITATION INPUT FREQUENCIES AND METHOD OF PARENT AND NEUTRAL LOSS SCANNING AND SELECTED REACTION MONITORING

[75] Inventors: Jodie V. Johnson, Alachua County, Fla.; Randall E. Pedder, Allegheny County, Pa.; Richard A. Yost, Alachua County, Fla.; Michael S. Story, Santa Clara County, Calif.

[73] Assignees: Finnigan Corporation, San Jose, Calif.; University of Florida, Gainesville, Fla.

[21] Appl. No.: 645,574

[22] Filed: Jan. 25, 1991

[51] Int. Cl.[5] ..... H01J 49/42

[52] U.S. Cl. ..... 250/292; 250/291; 250/282

[58] Field of Search ..... 250/291, 282, 292

[56] References Cited

U.S. PATENT DOCUMENTS 4,540,884 9/1985 Stafford et al. ..... 250/282

4,736,101 4/1988 Syka et al. ..... 250/292

*Primary Examiner*—Jack I. Berman

*Attorney, Agent, or Firm*—Flehr, Hohbach, Test, Albritton & Herbert

[57] ABSTRACT

This invention relates generally to a quadrupole ion trap mass spectrometer and method of operation and more particularly to an ion trap mass spectrometer in which pulses of energy of predetermined frequencies are applied across the end caps to independently and sequentially excite ions of different masses trapped in the ion trap to perform parent scanning, neutral loss scanning and selected reaction monitoring.

6 Claims, 4 Drawing Sheets

QUADRUPOLE ION TRAP MASS SPECTROMETER HAVING TWO PULSED AXIAL EXCITATION INPUT FREQUENCIES AND METHOD OF PARENT AND NEUTRAL LOSS SCANNING AND SELECTED REACTION MONITORING

BACKGROUND OF THE INVENTION

In U.S. Pat. No. 4,736,101 there is disclosed a method of performing MS/MS in a quadrupole ion trap. In this method a wide mass range of ions are created and stored in the ion trap during an ionization step of the analysis in a manner similar to that disclosed in U.S. Pat. No. 4,540,884. According to the equations which govern operation of quadrupole ion traps, ions of differing masses will have distinct and unique natural frequencies of oscillation in the ion trap. By application of a small supplemental ac voltage at this frequency applied by a synthesizer circuit, or the like, to the end caps of the electrodes of the ion trap, selected ions are caused to resonate and either enter into a collisionally-induced dissociation or are ejected from the ion trap. All other ions which have different masses remain unaffected by the supplemental ac field. Those ions which undergo collisionally-induced dissociation form daughter ions which are then trapped and can be scanned out of the device by ramping or increasing the r.f. voltage applied to the ring electrode as disclosed in U.S. Pat. No. 4,540,884.

Only a single mass is excited at any given time. For tandem mass spectrometry (MS/MS) this provides only daughter ion analysis of a single parent mass. The parent ion is selected by selecting the frequency of the applied supplemental voltage and the daughter ions are ejected by scanning. It is possible to obtain a reconstructed parent ion spectrum from a large number of successive daughter ion scans, each with its own ionization event. The time involved in acquiring the entire data set would prevent the use of this approach for obtaining parent ion information during routine mixture analysis.

In tandem mass spectrometry, three useful scan modes are the parent scan, neutral loss scan and selected or multiple reaction monitoring. The first two modes are very useful for screening analytical samples for the presence of specific classes of compounds, while the latter scan mode is useful for screening with high sensitivity the presence of specific compounds. These modes have not been implemented on quadrupole ion trap mass spectrometers.

In co-pending application Ser. No. 645,622 entitled, "QUADRUPOLE ION TRAP MASS SPECTROMETER HAVING TWO AXIAL MODULATION EXCITATION INPUT FREQUENCIES AND METHOD OF SCANNING," filed simultaneously herewith (FHTAH File No. A-54111/AJT), there is described an implementation of parent and neutral loss scans using an ion trap mass spectrometer. The apparatus and method involves the simultaneous application of two resonant excitation waveforms: one for CID of a series of parent ions, and the other for ejection of the resulting daughter ions of interest.

In certain modes of operation, the CID of the parent ion forms daughter ions which are not trapped and some ejection of parent ions which do not undergo CID occurs. These events, in sum, contribute to the ion current being detected at the frequency of the parent ion of interest.

OBJECTS AND SUMMARY OF THE INVENTION

The foregoing limitations are overcome with a pulse technique whereby one pulse at the parent ion frequency produces daughter ions from CID, and a second sequential pulse at the frequency of the daughter ions is employed to eject the daughter ion of interest for detection.

It is another object of the present invention to provide a quadrupole ion trap mass spectrometer in which parent and daughter ions are independently and sequentially excited by the application of pulses of energy of predetermined and different frequencies.

It is another object of the present invention to provide a quadrupole ion trap mass spectrometer in which parent ions are excited to undergo CID by pulses of energy at their resonant frequency, and daughter ions are subsequently excited at their resonant frequency and ejected from the ion trap.

These and other objects are achieved by an ion trap mass spectrometer in which means are provided for applying pulses of energy of predetermined frequency to the end caps to excite parent ions to cause CID, and means are provided for applying energy pulses at the resonant frequency of selected daughter ions to eject daughter ions following CID. The invention is also directed to the method of operating an ion trap to perform parent scan, neutral loss scan and selected reaction monitoring.

BRIEF DESCRIPTION OF THE DRAWINGS

The foregoing, and other objects of the invention, will be more clearly understood from the following description when read in connection with the accompanying drawings of which.

DESCRIPTION OF PREFERRED EMBODIMENT

Figure 1:
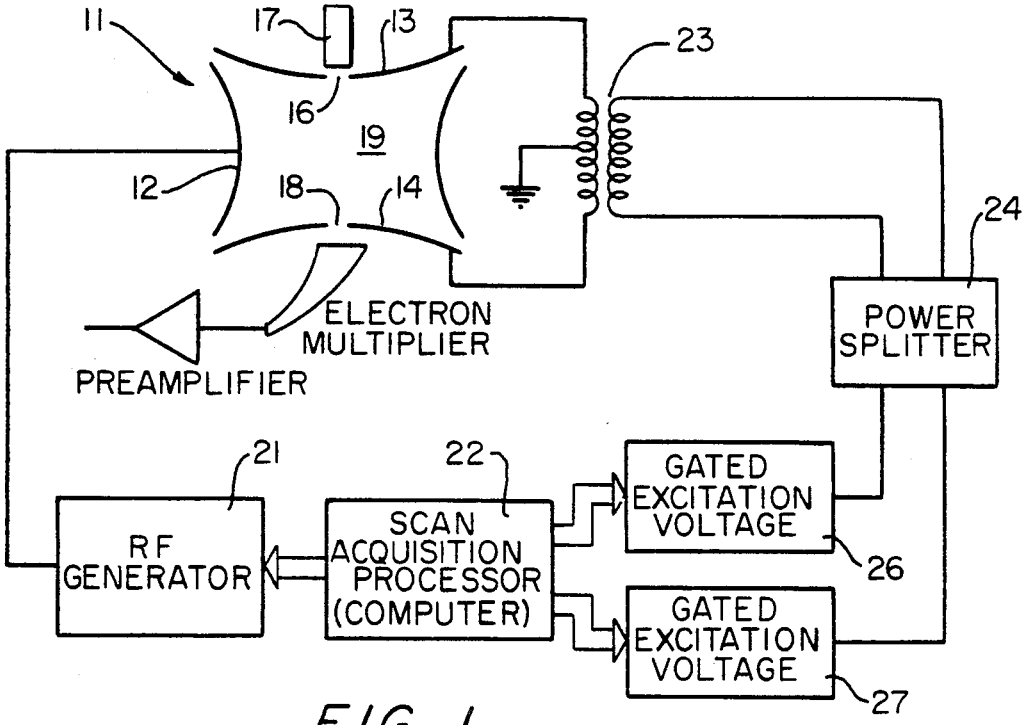
FIG. 1 is a schematic diagram of an ion trap mass spectrometer incorporating the present invention.

5 Referring to FIG. 1, an ion trap mass spectrometer is illustrated at 11. The mass spectrometer includes an ion trap having a ring electrode 12 and end cap electrodes 13 and 14. The electrode 13 includes an opening 16 through which electrons formed by the electron gun 17 may be ejected into the ion trap volume to ionize a sample. Alternatively, the sample may be ionized externally and the ions injected into the trap. In either event, ions of interest are introduced into the trap. The lower end cap 14 includes an aperture 18 which allows ions to escape the ion trap volume 19 and which ions are then detected by the electron multiplier, and the output of the electron multiplier is preamplified and supplied to associated processing equipment. An r.f. generator 21 applies suitable voltage to the ring electrode to generate trapping fields within the ion trap which trap ions over a predetermined mass range of interest. The r.f. generator is controlled via a scan acquisition processor (computer) 22. The end caps are connected to the secondary of a transformer 23 which applies supplemental or exciting voltages across the end caps. The primary of the transformer 23 is connected to a power splitter 24 which receives pulses of energy from the gated excitation voltage sources 26 and 27. The gated excitation voltage sources provide pulses of energy of predetermined frequency to the power splitter, which then combines and applies the waveforms to the transformer primary and to the end caps for excitation of ions within the ion trap 19. Operation of the gated excitation voltage sources 26 and 27 is controlled by the scan acquisition processor 22. It is apparent that a single waveform generator can be used to provide the excitation voltages.

In accordance with the present invention, a frequency pulse is applied by the gated excitation voltage source 26 through the power splitter to the end caps. The frequency of the voltage source is selected to be at the resonant frequency of a parent ion, and the application of the energy to the end caps causes a trapped parent ion to undergo CID. A second sequential pulse is applied from the gated excitation voltage source 27, and is applied following the application of the first pulse. This pulse is employed to eject the daughter ion of interest for detection. The ion current detected by the electron multiplier in the second pulse is a reflection of only the intensity of the parent ion leading to the selected daughter ion.

Figure 2:
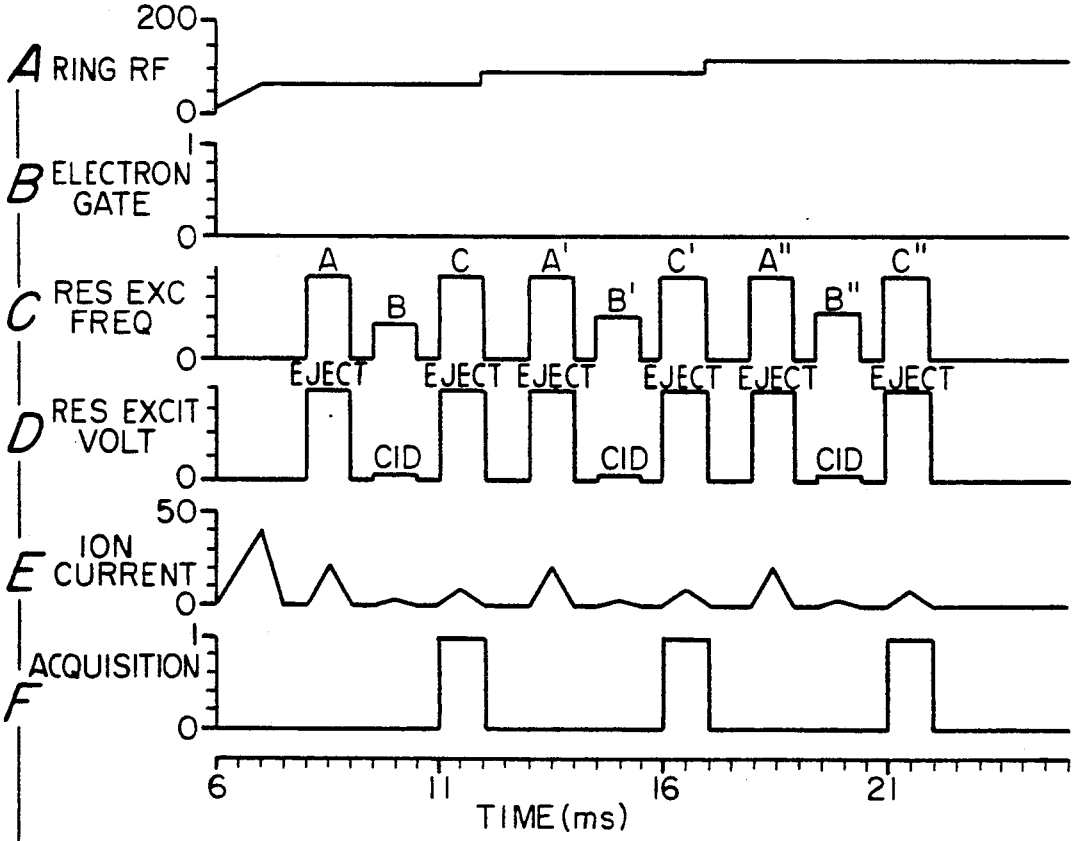
FIGS. 2A–F show application of pulses for a pulsed parent scan at a constant ring r.f. voltage.

By way of example, for a parent ion scan the sample is introduced into the trap volume 19, electron gun 17 is pulsed to ionize the sample and form parent ions, the ring electrode voltage is set to give the specific daughter ions of interest a high Mathieu q (i.e., $q=0.85$). With a constant r.f. voltage, this results in daughter ions having a constant and high secular frequency (approximately 425 kHz). However, the secular frequency of the parent will decrease with increasing m/z. Thus, a parent scan is implemented by the scan functions shown in FIG. 2. Following the ionization, the ring electrode voltage is increased to give the daughter ion of interest a q value of approximately 0.85 as shown in FIG. 2A. At this point, any ion of the daughter ion m/z of interest are ejected by application of a pulse of high voltage having a resonant excitation waveform at the frequency of the daughter ion (Pulse A) across the end cap electrodes 13 and 14. Then in sequence, the frequency and voltage of the resonant excitation waveforms are pulsed such that a parent ion undergoes CID (Pulse B), and then any resulting daughter ions are ejected and detected by application of Pulse C. The frequency of the daughter ion resonant excitation waveform pulse is set to match the secular frequency of the daughter ions of interest, e.g., m/z 91. The voltage of the daughter ion resonant excitation waveform is set high enough to cause rapid ejection of this specific daughter ion from the ion trap to the detector. The frequency of the parent ion resonant excitation is varied with each pulse, so that during successive pulses (B, B', B'', etc.), successive parent ions undergo CID. The voltage of the parent ion waveform is adjusted such that resonant excitation leads to CID of the parent ion with minimum resonant ejection. The acquisition of ion current occurs only during the daughter ion ejection pulses (C, C', C'') which can be related to the parent ion m/z of Pulses B, B', B'', etc. Thus, a parent spectrum can be obtained. Although one could increment the frequency of the parent ion resonant excitation pulses in either direction, it is preferable to decrease the frequency from high frequency to low frequency corresponding to a scan from low m/z to high m/z. It is also noted that the secular frequency of an ion is roughly inversely related to its m/z value.

Operation of the ion trap mass spectrometer in the pulsed mode will be more clearly understood from the following examples of EI-CID pulsed parent scan of 91+for a series of n-alkylbenzenes. To investigate the potential of the pulsed parent scan method, a MRM (multiple reaction monitoring) parent scan was devised where only selected parent ions of interest were resonated to undergo CID to a particular daughter ion.

Figure 3:
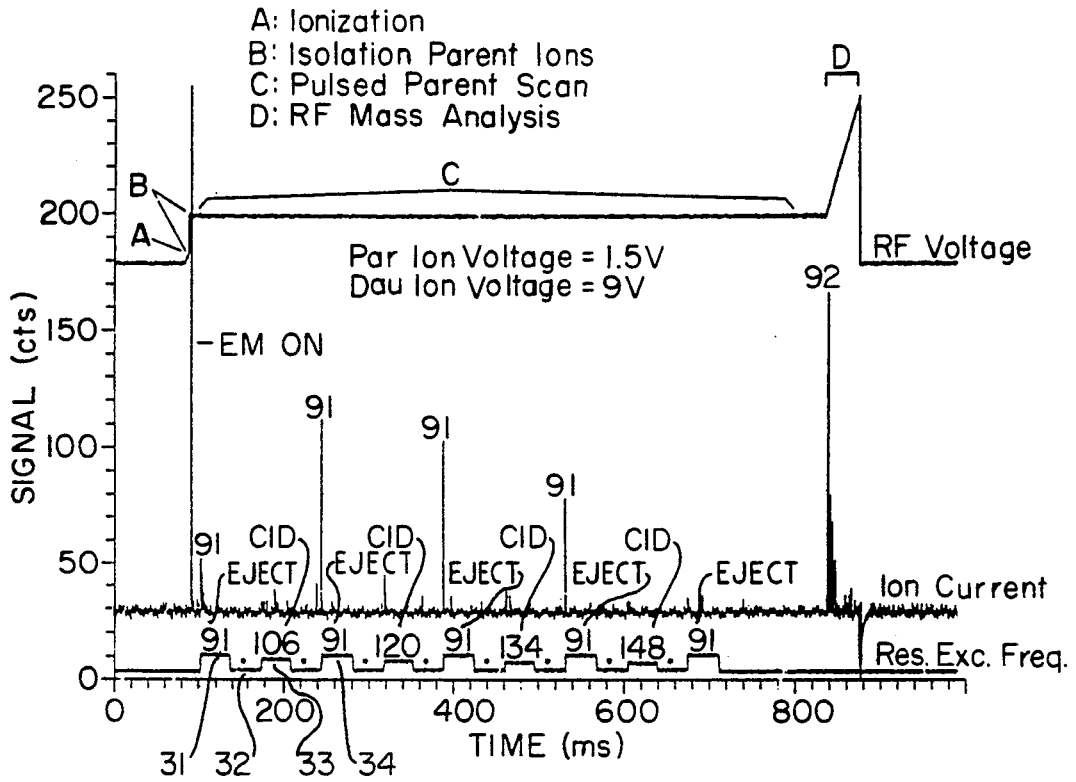
FIG. 3 shows a pulsed parent scan of the 91+daughter ion for m/z 106, 120, 134, and 148 parent ions.

The implementation of the MRM pulsed parent scan is illustrated in FIG. 3. The r.f. voltage trace shows that the ion trap mass spectrometer scan function utilized was essentially a daughter scan function with a long CID period (750 ms) but without the resonant excitation waveform (tickle) of the ion trap mass spectrometer. Following ionization A, the ions up to and including m/z 91 were ejected from the ion trap B and then the r.f. voltage was lowered to a low m/z cutoff of m/z 86. While at this r.f. level, the MRM pulsed parent scan was implemented with the resonant excitation waveforms from a synthesizer. Finally, the r.f. voltage was ramped, D, for mass analysis of the ions remaining in the trap following the MRM pulsed parent scan.

The MRM pulsed parent scan was accomplished during the CID period of the scan function by pulsing the voltage and frequency of the resonant excitation waveform. The parent ion was excited with a nominal 1.5 V and the daughter ion was excited with 9 V. The sequence of frequency and voltage changes is shown by the resonant excitation frequency trace of FIG. 3. Prior to beginning CID of the parent ions, any m/z 91 ions formed during the ionization and still remaining in the ion trap after the r.f. isolation were ejected from the trap with a daughter ion frequency pulse 31. Then for each parent ion-daughter ion combination, the following sequence occurred.

1. Change to a low frequency at which no ions are in resonance (500 Hz), 32.
2. Change voltage to that for parent ion CID (1.5 V).
3. Change frequency to that of parent ion: resonant excitation and CID of the parent ion occurs to produce daughter ions, 33.
4. Change to low frequency (500 Hz), 32.
5. Change voltage to that for ejection of the daughter ion (9.0 V).
6. Change frequency to that of daughter ion: resonant excitation and ejection of daughter ion occurs, 34.
7. Go to step 1 and repeat for the next parent ion-daughter ion combination.

Figure 4:
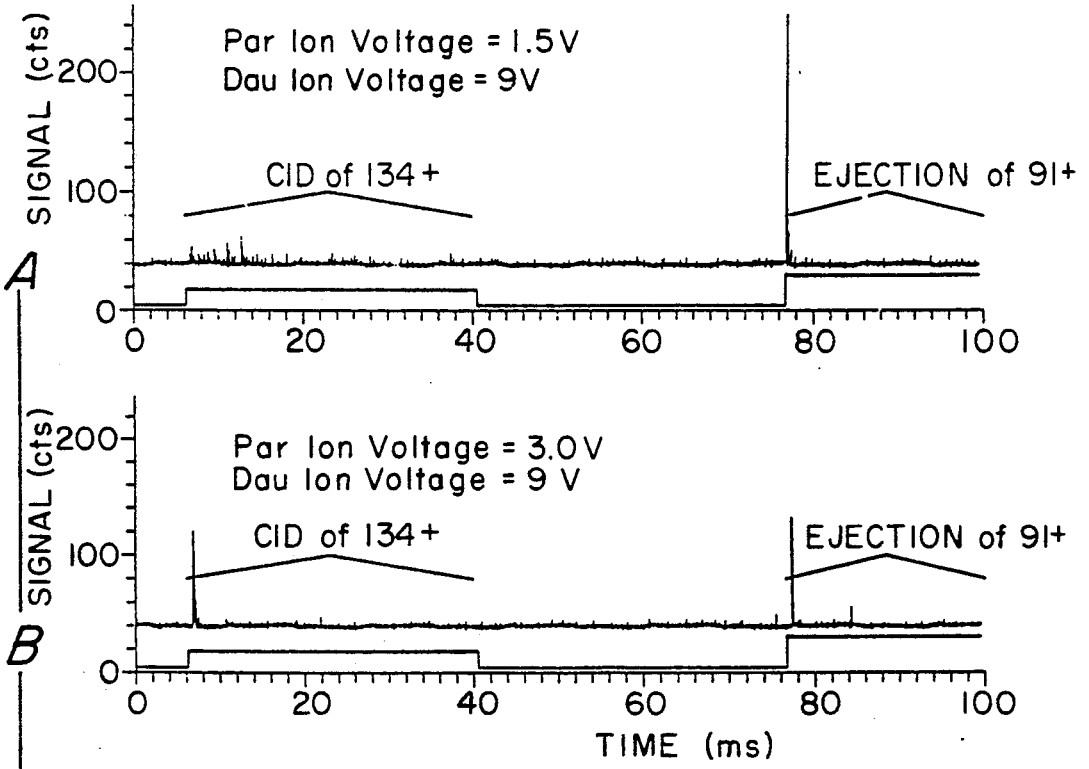
FIG. 4 shows the sequence for the pulsed CID of the M+ion (m/z 134) of n-butylbenzene to form 91+daughter ions.
Figure 5:
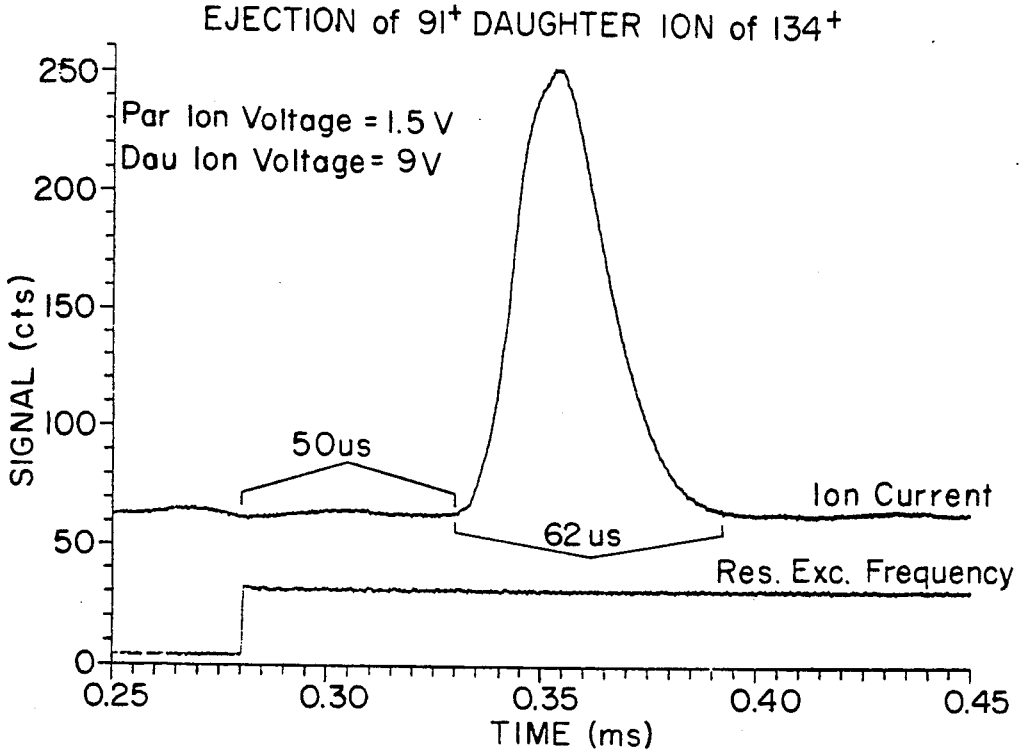
FIG. 5 is an enlarged view showing the 91+daughter ion from the CID of the M+ion (m/z 134) of n-butylbenzene.

The ion current which results from this experiment is displayed in FIG. 3. The first large peak occurs when the electron multiplier is first turned on. Note that the ion current detected during the parent ion CID pulses is relatively small, but that a good signal is obtained for each of the daughter ion ejection pulses. The ion currents detected during each of the pulses are examined in more detail in FIG. 4, where the sequence for the CID of the M+ion (m/z 134) of n-butylbenzene to form the 91+ion (enlarged from FIG. 3) is shown. During the parent ion CID period, some ion current is detected; this ion current is either due to ejection of the parent ion or formation of daughter ions below the low m/z cutoff of the r.f. voltage on the ring electrode (in this case, m/z 86). With a doubling of the voltage of the parent ion resonant excitation waveform from 1.5 to 3.0 V, a significant increase in the intensity of the ion current during the parent CID period is noted (FIG. 4B) due to increased ejection of the parent ion. This illustrates the importance of control of the amplitude of both the parent ion CID pulse and the daughter ion ejection pulse. If the daughter ion ejection pulse in FIG. 4A is examined more closely, it is found that a very nice peak profile is obtained that is relatively narrow ($\approx$62 $\mu$s base width) and appears after a relatively short delay ($\approx$50 $\mu$s) (FIG. 5).

These results indicate that the preferable method for implementing a parent scan on the ion trap mass spectrometer is that of alternately resonantly exciting the parent ion to undergo CID and then resonantly exciting the daughter ion to cause ejection. With a constant time period for each of these pulses, the optimum resonant excitation voltage can be used for each parent ion. This is especially important because, as the mass of the parent ion increases (its q-value decreases) for a constant r.f. level, the maximum amount of resonant excitation voltage which can be applied in a given time period before ejection of the parent ion occurs decreases. In addition, it is obvious that this pulsed method can be used for multiple reaction monitoring as demonstrated here, where any number of parent ion-daughter ion combinations can be used, not just a single type; for instance $134^+ \rightarrow 91^+$, $134^+ \rightarrow 92^+$.

Figure 6:
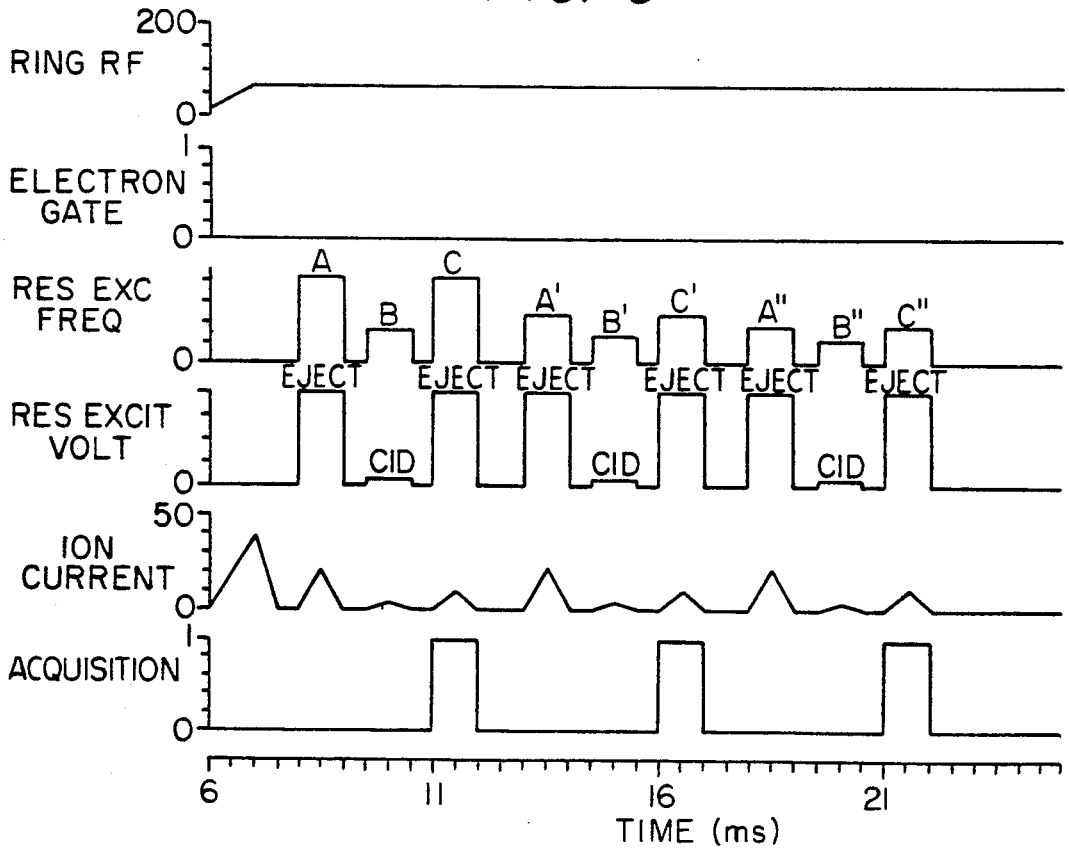
FIG. 6 shows the ion trap mass spectrometer scan function for implementation of a neutral loss scan at a constant ring r.f. voltage.
Figure 7:
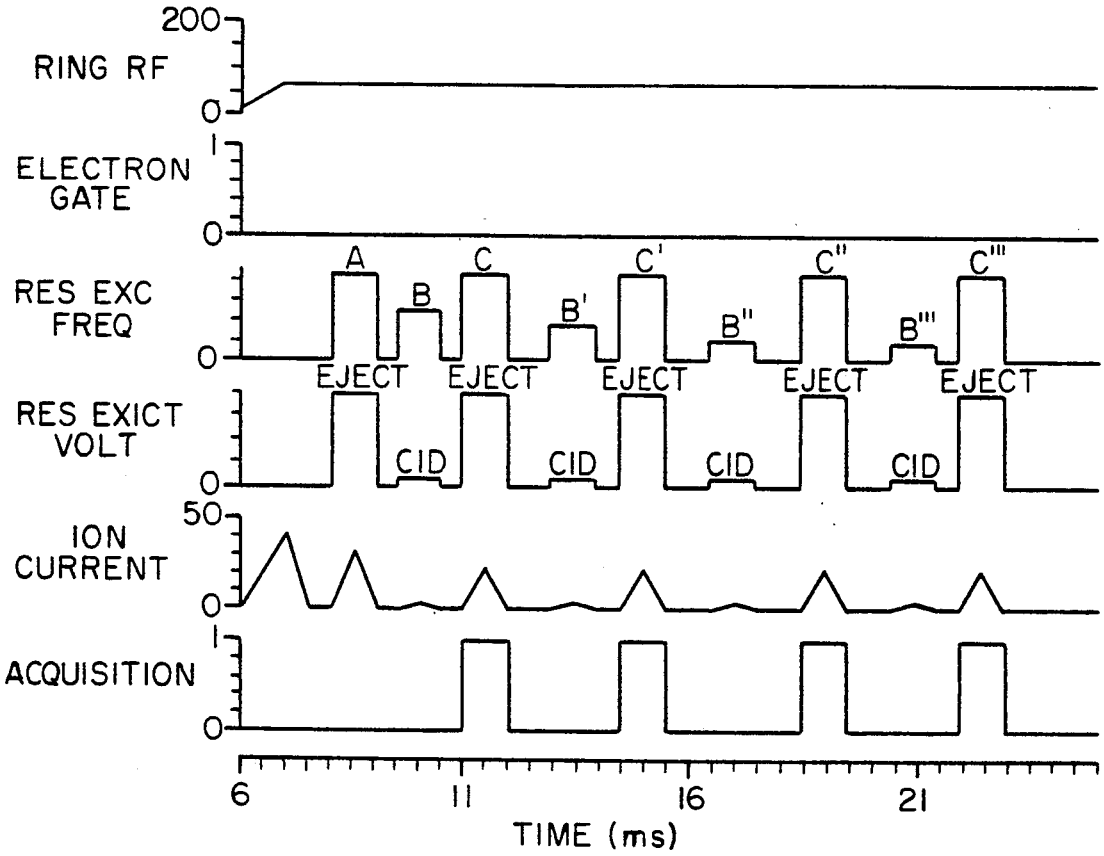
FIG. 7 shows an ion trap mass spectrometer scan function for implementation of a neutral loss scan with a constant daughter ion q.

Implementation of a neutral loss scan is similar to implementation of a parent scan. Whereas for the parent scan only a single parameter was varied (i.e., the frequency of the parent ion resonant excitation waveform), to implement a neutral loss scan, two parameters (ring r.f. voltage and the frequencies of the parent and daughter ion resonant excitation frequencies) related to the m/z of parent and daughter ions must be scanned simultaneously. In the first implementation (FIG. 6), the ring r.f. voltage is kept constant. The secular frequencies of the parent and daughter ions both decrease with increasing daughter ion m/z. Implementation of a neutral loss scan with constant r.f. voltage is obtained with the scan function of FIG. 6. In the second implementation, the ring r.f. voltage would be scanned linearly with the daughter ion m/z such that the daughter ion had a constant and high Mathieu q (0.85) and thus, a constant and high secular frequency. The frequency of the parent ion resonant excitation waveform would then be scanned simultaneously with the ring r.f. voltage, but again in a non-linear manner, FIG. 7.

Thus, there has been provided an ion trap mass spectrometer and method of operation in a pulsed excitation mode for performing parent scans, neutral loss scans and reaction monitoring.

What is claimed is:

1. In a quadrupole ion trap mass spectrometer of the type which includes a ring electrode and end caps defining a trap volume, means for applying voltages to said electrodes to generate within the ion trap volume trapping fields which trap selected ions, means for applying pulses of energy having a frequency which resonantly excites a trapped parent ion, and means for applying pulses of energy having a second predetermined frequency following each of said first pulses to excite and eject daughter ions.

2. A quadrupole ion trap mass spectrometer as in claim 1 in which said means for applying pulsed excitation voltage waveforms between said end cap electrodes comprises a first means for applying pulses, each successive pulse having a different excitation frequency and second means for applying excitation pulses each having the same excitation frequency.

3. A quadrupole ion trap mass spectrometer as in claim 2 in which said second means for applying excitation pulses to said end caps comprises means for applying pulses each having a different excitation frequency.

4. The method of scanning a quadrupole ion trap mass spectrometer of the type which includes a ring electrode and end caps defining a trapping volume, comprising the steps of introducing ions of interest into said trapping volume, applying voltages to said electrodes to provide a trapping field for trapping parent ions having masses over a range of interest, maintaining the voltage applied to said ring electrode constant, applying first voltage frequency pulses with successive pulses having different frequencies to excite different parent ions and cause said parent ions to resonate and undergo collision-induced dissociation to form daughter ions, and applying second voltage frequency pulses at the resonant frequency of a daughter ion to cause daughter ions to resonate and undergo ejection from the ion trap to the detector for the purpose of performing parent scanning, neutral loss scanning and selected reaction monitoring.

5. A method as in claim 4 in which said second frequency voltage pulses have different frequencies to excite different daughter ions.

6. A method as in claim 4 in which the voltage applied to said ring electrode is changed in synchronism with the application of each of said first and second voltage frequency pulses.

* * * * *